US007449979B2

(12) United States Patent
Koh et al.

(10) Patent No.: US 7,449,979 B2
(45) Date of Patent: Nov. 11, 2008

(54) COUPLED RESONATOR FILTERS FORMED BY MICROMACHINING

(75) Inventors: Philip J. Koh, Centreville, VA (US); David T. Nemeth, Washington, DC (US)

(73) Assignee: Sophia Wireless, Inc., Chantilly, VA (US)

( * ) Notice: Subject to any disclaimer, the term of this patent is extended or adjusted under 35 U.S.C. 154(b) by 282 days.

(21) Appl. No.: 10/534,289

(22) PCT Filed: Nov. 7, 2003

(86) PCT No.: PCT/US03/32743

§ 371 (c)(1),
(2), (4) Date: Apr. 24, 2006

(87) PCT Pub. No.: WO2004/045018

PCT Pub. Date: May 27, 2004

(65) Prior Publication Data

US 2006/0232364 A1 Oct. 19, 2006

Related U.S. Application Data

(60) Provisional application No. 60/424,620, filed on Nov. 7, 2002.

(51) Int. Cl.
*H01P 1/20* (2006.01)
*H01P 7/00* (2006.01)

(52) U.S. Cl. ..... 333/202; 333/230

(58) Field of Classification Search ..... 333/202, 333/207, 230, 246, 247
See application file for complete search history.

(56) References Cited

U.S. PATENT DOCUMENTS

| | | | | |
|---|---|---|---|---|
| 3,471,811 | A | 10/1969 | Klotz | |
| 3,626,327 | A | 12/1971 | Belmont et al. | |
| 3,863,181 | A | 1/1975 | Glance | |
| 4,320,367 | A * | 3/1982 | Boujet | 333/209 |
| 4,368,402 | A | 1/1983 | Torii et al. | |
| 4,922,211 | A | 5/1990 | Otremba et al. | |
| 5,796,321 | A * | 8/1998 | Caillat et al. | 333/246 |
| 5,821,836 | A | 10/1998 | Katechi et al. | |
| 6,057,600 | A | 5/2000 | Kitazawa et al. | |
| 6,603,376 | B1 * | 8/2003 | Handforth et al. | 333/238 |
| 6,888,427 | B2 * | 5/2005 | Sinsheimer et al. | 333/238 |
| 7,298,234 | B2 * | 11/2007 | Dutta | 333/246 |

* cited by examiner

*Primary Examiner*—Robert J. Pascal
*Assistant Examiner*—Kimberly E Glenn
(74) *Attorney, Agent, or Firm*—Sughrue Mion, PLLC

(57) ABSTRACT

A resonator filter assembly is provided having a first wafer (102), a second wafer (104) and a third wafer (106). A plurality of pits are etched in the first and second wafer (102, 104) and arranged such that a plurality of resonant cavities (108) are formed with a coupling cavity (110) disposed between the resonant cavities (108). By altering the dimensions of the resonant and coupling cavities (108, 110), the frequency characteristics of the filter can be adjusted as desired.

19 Claims, 10 Drawing Sheets

COUPLED RESONATOR FILTERS FORMED BY MICROMACHINING

CROSS-REFERENCE TO RELATED APPLICATIONS

This application claims benefit of Provisional Application No. 60/424,620 filed Nov. 7, 2002, the disclosure of which is incorporated herein by reference.

This invention was made with Government support under Contract F30602-02-C-0044awarded by the Air Force. The Government has certain rights in this invention.

BACKGROUND OF THE INVENTION

1. Field of the Invention

The present invention relates to coupled resonator filters. More particularly, the present invention relates to coupled resonator filters formed by micromaching techniques and a method for making the same.

2. Related Art

Microwave filters are devices that pass some microwave signals and reject others, based on the frequency of the signal. Conventionally, microwave filters are made using resonate structures in different arrangements. Depending on the arrangement of the resonant structures, filters can be made which are low-pass (i.e., pass lower frequencies and reject higher frequencies), high pass (i.e., pass higher frequencies and reject lower frequencies), band pass (i.e., pass a limited range of frequencies), and band reject (i.e., reject a limit range of frequencies).

Filters can also be combined to form other devices, such as diplexers. Diplexers take an input signal, and send one band of frequencies to one output, and another band of frequencies to another output. Other configurations of this type are possible, although less commonly used.

There are many ways of evaluating the electrical performance of a bandpass filter. Different characteristics will be important, depending on the application that the filter is being used in. For example, insertion loss describes the amount of energy lost in a signal that is supposed to be passed, rejection describes the amount of energy that is supposed to be blocked at a given frequency, but which is passed through, and passband flatness describes the variation of insertion loss over the range of frequencies which are passed. These various parameters are mutually dependent on each other. For example, better rejection can be designed at the expense of either passband flatness or insertion loss.

There is, however, a fundamental figure of merit for a resonator filter which defines how good a filter can be made from a series of similar resonators. This figure of merit is known as the quality factor, or Q, of the resonator. Roughly, it is the inverse of the fraction of energy lost for each oscillation of the resonator. For a technology with a higher resonator Q, a filter with better characteristics can be made than a filter with lower Q. For example, a higher resonator Q filter could be made with better insertion loss than a filter with lower Q resonators, with all other characteristics being the same.

Conventionally, higher Q filter technology utilizes machined cavities in metal as the resonator structure. However, because conventional machining is not precise enough to exactly give the desired filter response, tuning structures such as screws are needed to "tune up" a filter to give it an optimized response. A disadvantage of this type of structure is that it requires manual adjustment of the filter by a technician to give the optimum response.

The most common type of micromachined filter utilizes thin lines of suspended metal. The metal can either be strips attached at either end and hanging suspended, or an arbitrary shaped pattern on a very thin dielectric. By removing the surrounding dielectric, the resonator Q is improved.

However, this type of filter suffers from the thinness of the resonator line (the deposited metal is usually no more than a few microns thick) and the edge coupling of the resonators. This concentrates the currents along the edge of the resonator, which increases the ohmic losses, and reduces the resonator Q. This design also can be susceptible to small mechanical vibrations known as microphonics, which can modulate a signal passed through the filter.

Therefore, what is needed is a filter design having the advantages of higher resonator Q, which translates into lower insertion loss and better rejection, while also exhibiting an immunity to microphonics and a reduced manufacturing complexity.

SUMMARY OF THE INVENTION

The above and other features of the invention including various and novel details of construction and combination of parts will now be more fully described with reference to the accompanying drawings and pointed out in the claims. It will be understood that the particular features embodying the invention are shown by way of illustration only and not as a limitation of the invention. The principles and features of this invention may be employed in varied and numerous embodiments without departing from the scope of the invention.

In an illustrative embodiment of the present invention, a resonator assembly is provided which forms a filter. The resonator assembly comprises at least a first wafer and a second wafer. A plurality of pits are etched in the first and second wafers and are arranged such that a plurality of resonant cavities are formed with a coupling cavity disposed between the resonant cavities. By altering the dimensions of the resonant and coupling cavities, the frequency characteristics of the filter can be adjusted as desired.

In another illustrative embodiment of the present invention, a resonator assembly is provided comprising a first wafer having at least one pit etched therein, a second wafer having at plurality of pits etched therein, a third wafer having at least one pit etched therein, and a fourth wafer coupled to the third wafer. The plurality of pits etched in the second wafer are etched such that the second wafer forms a beam that extends from at least one end of the resonator structure.

In another illustrative embodiment of the present invention, a tuning structure for a resonator assembly is provided. The tuning structure may comprise a piece of dielectric inserted into an aperture of a wafer, a metal cap provided in an aperture of a metal layer, or a capacitive element disposed in proximity to an aperture formed in a metal layer.

The above and other features of the invention including various and novel details of construction and combination of parts will now be more fully described with reference to the accompanying drawings and pointed out in the claims. It will be understood that the particular features embodying the invention are shown by way of illustration only and not as a limitation of the invention. The principle and features of this invention may be employed in varied and numerous embodiments without departing from the scope of the invention.

BRIEF DESCRIPTION OF THE DRAWINGS

Aspects of illustrative, non-limiting embodiments of the present invention will become more apparent by describing in detail embodiments thereof with reference to the attached drawings in which.

DETAILED DESCRIPTION OF THE INVENTION

The following description of illustrative non-limiting embodiments of the invention discloses specific configurations, features, and operations. However, the embodiments are merely examples of the present invention, and thus, the specific features described below are merely used to more easily describe such embodiments and to provide an overall understanding of the present invention.

Accordingly, one skilled in the art will readily recognize that the present invention is not limited to the specific embodiments described below. Furthermore, the description of various configurations, features, and operations of the present invention that are known to one skilled in the art are omitted for the sake of clarity and brevity. Also, it is to be understood that the phraseology and terminology employed herein is for the purpose of description and should not be regarded as limiting.

An illustrative embodiment of the present invention is described with reference to a bandpass filter. Bandpass RF filters are constructed out of a series of coupled resonators. By tuning the coupling between the resonators and the frequencies of the resonators, the desired filter characteristics can be achieved. What is needed in the fabrication process is the flexibility to make resonators of the desired frequencies, and the ability to control the coupling strength between the resonators. A method is also needed for coupling the signal into and out of the series of coupled resonators.

Figure 1A:
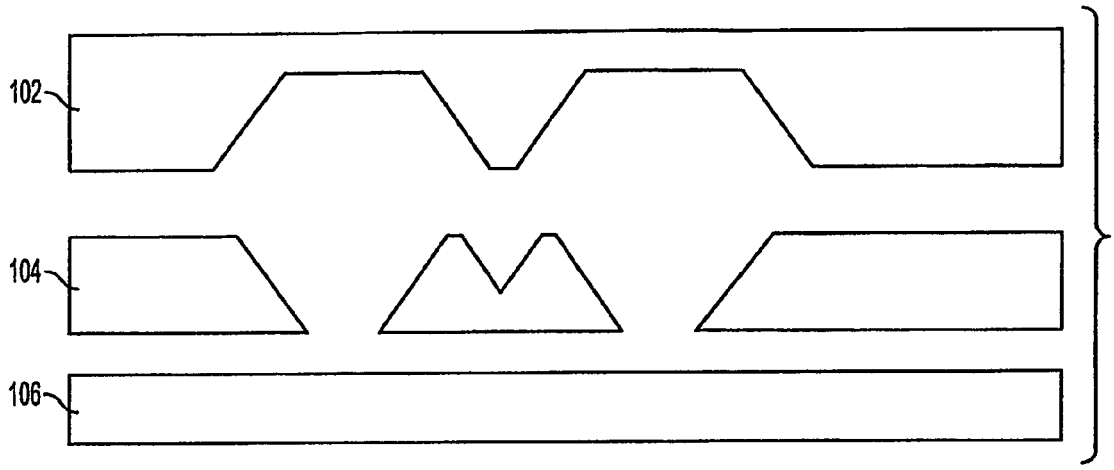
FIGS. 1A and 1B show a resonator filter structure according to an illustrative embodiment of the present invention.

In a first illustrative embodiment of the present invention, the resonators are cavities formed from rectangular pits etched in silicon. FIG. 1A shows three separate <100> oriented silicon wafers; namely, a top wafer 102, a middle wafer 104 and a bottom wafer 106. Wafers 102, 104 and 106 are coated with an etch mask, such as silicon nitride or silicon oxide, thereby forming masking layers.

The masking layers are patterned using standard photolithographic techniques as is known in the art. Wafers 102, 104 and 106 are then etched in an anisotropic silicon etch, which etches the <111> planes of silicon much more slowly than the other planes. As a result, the precision of the two-dimensional masking layer is transferred to the final three-dimensional pit.

Top wafer 102 in the stack is etched until a pit height reaches a specified depth. Alternatively, an etch stop layer, such as a buried silicon oxide layer, can be used, which makes the etch self-terminating. The masking layer is then stripped. A barrier layer may be grown or deposited at this point, such as silicon oxide or silicon nitride. The barrier layer has no electrical significance, but may be needed to prevent migration of silicon into the subsequent metal layer. This prevents the metal layer suffering from a loss of conductivity, or causing bonding problems. The need for such a layer depends on the metals used, as well as subsequent processing steps.

Next, a thin layer of metal is deposited using a standard metal deposition technique, such as sputtering. The deposited metal is then electroplated to a thickness sufficient to reduce the ohmic losses as much as possible. Middle wafer 104 is patterned on both sides, and pits are then etched. The etch does not have to be precisely timed, as all the patterns are self-terminating. Bottom wafer 106 does not need to be etched at all, but is covered in metal.

Figure 1B:
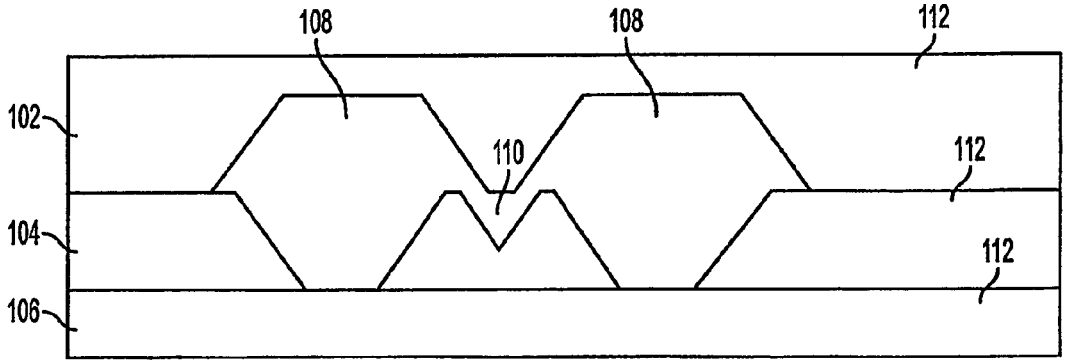

The three wafers 102, 104 and 106 are then bonded together as shown in FIG. 1B. The bonding can be accomplished by any of several methods, so long as the bond gives good electrical conductivity between the metal on the various wafers. Some examples of suitable bonding methods are direct gold-to-gold thermo-compression bonding, or bonding with an intermediate bonding layer, such as Gold-Tin eutectic.

Inside the bonded wafers 102, 104 and 106 is a series of connected cavities.

FIG. 1B shows a cross section of two resonant cavities 108 with a weak coupling cavity 110 formed therebetween. Cavities 108 are air or vacuum spaces and are surrounded by support silicon 112. The bonded wafers 102, 104 and 106 are covered in a high conductivity metal, such as gold (not shown).

The large cavities 108 form the resonators, and the small cavities 110 connecting the resonators form a weak coupling cavity between the resonators. The frequency of each resonator 108 can be adjusted by changing the lateral dimensions of the cavity. The coupling strength between resonators 108 can be adjusted by adjusting the lateral dimensions of the coupling cavity 110. The filter characteristics can also be adjusted by providing additional large cavities 108 and coupling cavities 110. Hence, this process has all of the degrees of freedom required to design a filter.

The illustrative embodiment shown in FIG. 1 has several advantages over conventional micromachined filters using suspended metal lines. By forming the resonant structure as a cavity, instead of a thin line, the electrical losses are greatly reduced which results in a much higher resonator Q.

In addition, because there are no thin suspended structures, the filter shown in FIG. 1 is not susceptible to microphonics in the same way as conventional micromachined filters, it is mechanically stronger than conventional micromachined filters using suspended metal lines and the processing involves fewer steps.

The illustrative embodiment shown in FIG. 1 also has several advantages over conventional machined filters. Due to the high accuracy of micromachining, tuning of the filter is not required in most applications. Conventional waveguide filters, with similar insertion loss characteristics, are substantially larger and heavier, and are more difficult to make with surface mount or wirebond compatible connections. These types of filters must be individually machined and tuned, which is less efficient than the batch fabrication process used for micromachined filters.

Figure 2A:
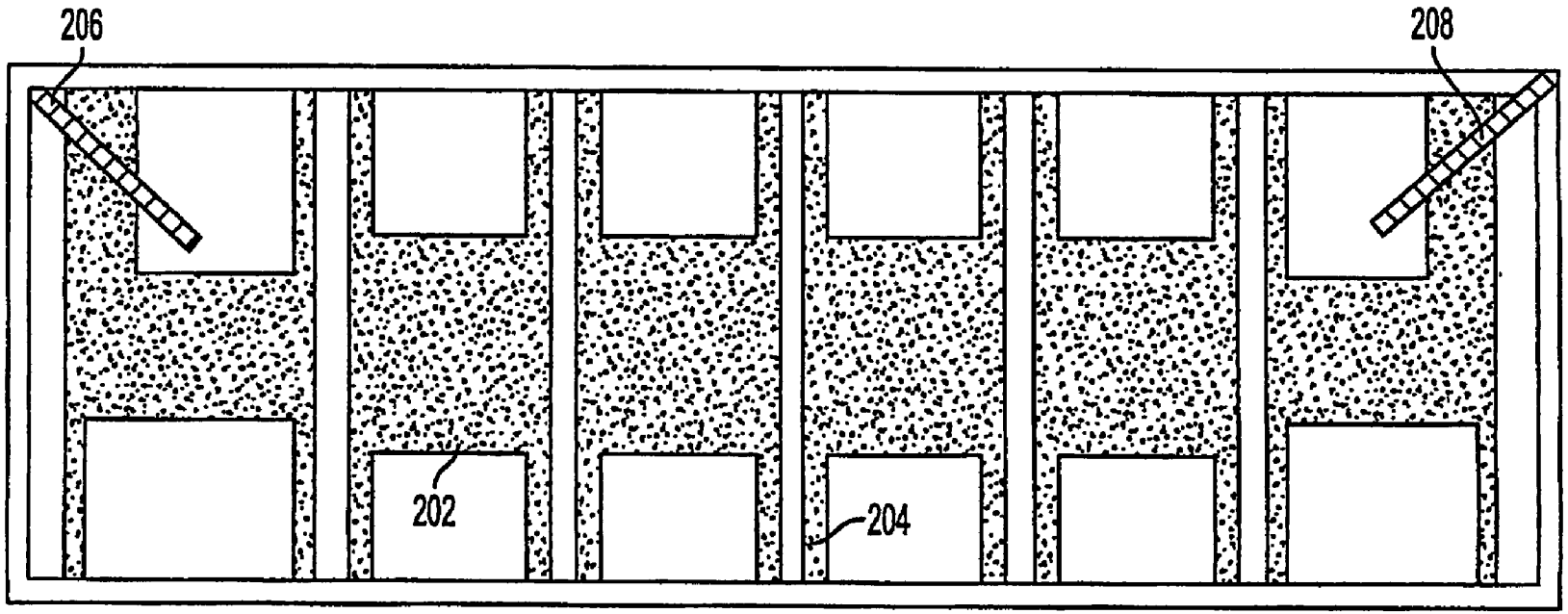
FIGS. 2A and 2B show a resonator filter structure according to another illustrative embodiment of the present invention.

FIG. 2A illustrates another exemplary embodiment according to the present invention which shows a cross-sectional view of a plurality of suspended silicon beams 202. The suspended silicon beams 202 are coated in metal and are used as the resonant elements.

In this illustrative embodiment, the resonators are suspended silicon beams 202 having four legs 204. The entire structure is coated in metal, and the suspended beams 202 are enclosed by a metal cavity formed by the other wafers. The frequency of the resonator is determined by the dimensions of the structure, and the coupling between resonators is determined by the gap between the suspended silicon beams 202. An input structure 206 and output structure 208 are used to couple a signal into and out of the filter.

Figure 2B:
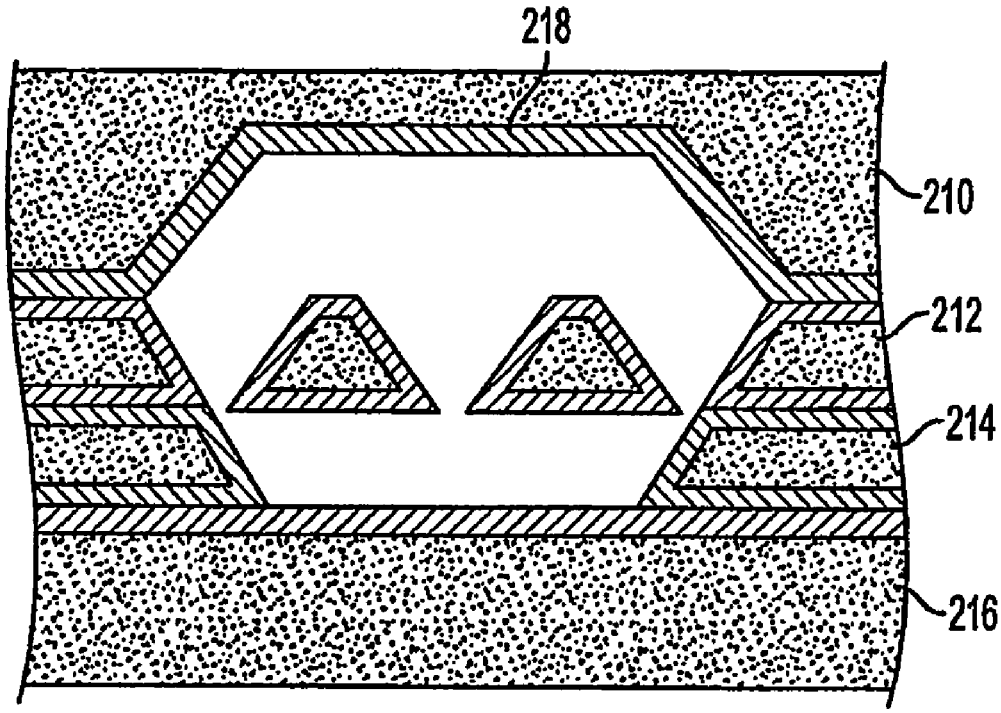

The process for making this filter is very similar to the method described above with reference to the cavity resonator filter of FIG. 1. As shown in FIG. 2B, in this embodiment, four separate wafers 210, 212, 214 and 216 are used. After the wafers are patterned and etched, the remaining silicon is coated with a metal layer 218 as shown in FIG. 2B.

This structure has an advantage of smaller size for a given frequency than the cavity structure described above. In addition, it can be formed using wet etching of silicon using an anisotropic silicon etch, such as Potassium Hydroxide. When formed in this manner, no convex corners are formed, thereby simplifying the design and fabrication.

In addition to the benefit of reduced device size, the beam structure illustrated in FIG. 2 relieves some of the requirements for dimensional accuracy. Whereas the resonant cavity type filter, as described with reference to FIG. 1, requires all of the etched cavity dimensions to be precise, for the filter shown in FIG. 2, only the wafer in which the beams are formed has very high requirements for accuracy. This accuracy is not difficult to achieve, as all of the features formed are self-terminating in an anisotropic silicon etch, removing the need for precise etch depth control.

FIG. 3 shows an input/output coupling structure for a resonant cavity filter. From an electrical point of view, there is no difference between a structure that couples energy into a filter and one that couples energy out of the filter. For that reason, the input/output structures will simply be referred to as input structures.

In designing the input structure, there are multiple factors to consider. First, the design should allow for a range of coupling strengths from the input line to the first resonator. Second, the input structure should not add too much size to the device. Finally, the connection to external transmission lines should be convenient for users of the filter.

Figure 3A:
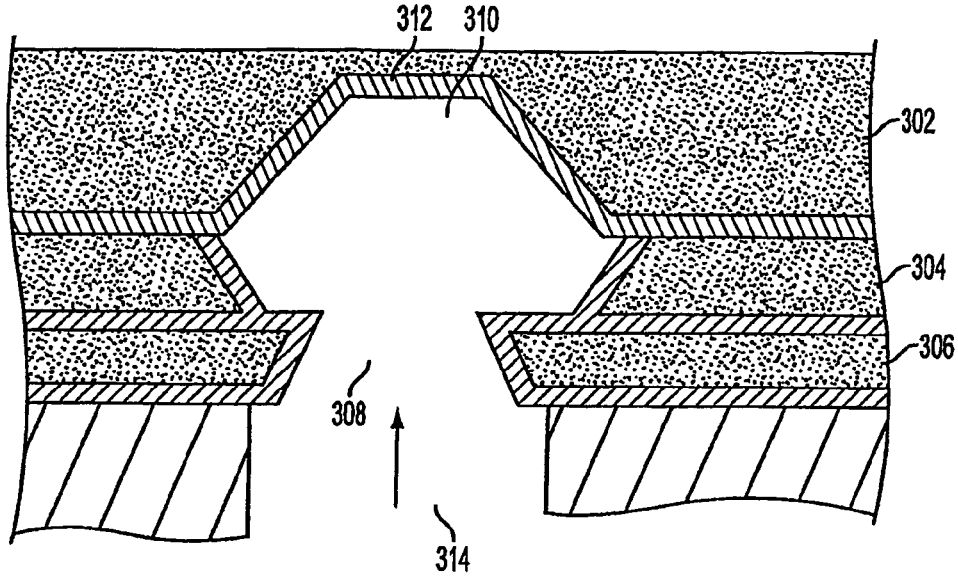
FIGS. 3A-3C show a coupling structure according to an illustrative embodiment of the present invention.

FIG. 3A illustrates an input/output coupling structure according to an illustrative embodiment of the present invention. The cavity resonator includes a top wafer 302, a middle wafer 304 and a bottom wafer 306. The coupling structure 308 is typically located on the bottom wafer 306. This allows easy access to the input and output ports. One aspect of the bottom wafer 306 is that it can be used solely to form the flat bottom of any cavities, and hence does not have the same stringent requirement for dimensional accuracy as the other wafers 302 and 304 in the stack.

FIG. 3 depicts one resonant cavity 310. However, as discussed above with reference to FIG. 1, multiple resonant cavities and coupling cavities can be provided depending on the desired characteristics of the filter.

The bottom wafer 306 should be a low loss dielectric with a good match of coefficient of thermal expansion to the top wafer 302 and middle wafer 304. The match of thermal expansion coefficients is important to avoid stress on the bonds of the wafer, or even outright failure. If the top wafer 302 and middle wafer 304 are made of silicon, exemplary materials that could be used for the bottom wafer include undoped silicon and glass. These materials are mentioned as examples only and are not intended to be limiting.

The coupling structure 308 shown in FIG. 3A involves opening an aperture into cavity 310 in which an input signal is coupled into. The input signal path is shown by the arrow in FIG. 3A. Note that for the suspended resonator type devices, as described above with reference to FIG. 2, the cavity refers to the cavity in which the resonator is suspended. For the cavity resonators, as described above with reference to FIG. 1, the cavity itself is the resonator.

The opening aperture 308 can either be an air aperture or a dielectric aperture.

The air aperture 308 is shown in FIG. 3A. This structure involves forming a precise hole into the cavity 310. The walls of cavity 310 are coated with metal 312. For the weak coupling required of a bandpass filter, the aperture 308 will be cut off for the frequency of interest. This aperture can either be fed directly by a waveguide 314, or it can be fed by an external probe. Using an external probe allows for the possibility of tuning the coupling strength, if desired. This tuning is not, however, required.

An illustrative method of forming air aperture 308 is described with reference to a pyrex wafer. First, an aperture is cut in the pyrex wafer by a laser, ultrasonic drilling, or any other suitable method. The shape and size of the aperture will depend on the details of the electromagnetic design. Different filter characteristics require different coupling strengths, so the details of a given filter design will affect the size and shape of the aperture. A common shape would be a rectangular hole with rounded corners, although other shapes could also be used.

After the aperture is cut, other via holes required by the design are cut. Metal is deposited on both sides and all the hole side walls. The metal is then patterned as needed, typically using photolithography and etching. The sidewall of the coupling aperture does not need to be perfectly vertical. For example, an aperture could also be formed by anisotropic silicon etching, with sidewalls slanted at approximately 54.7 degrees relative to the wafer surface.

Figure 3B:
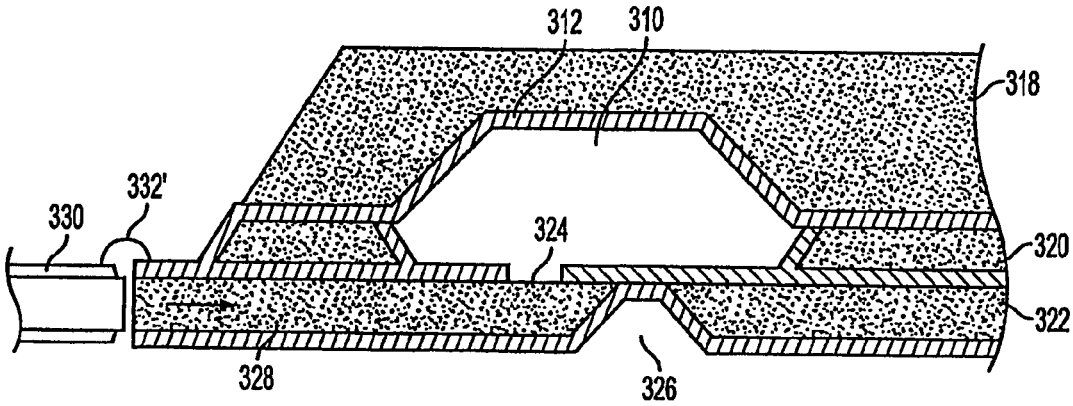

FIG. 3B shows an alternative coupling structure which utilizes a dielectric aperture 324 for coupling a signal into cavity 310. A top wafer 318, a middle wafer 320 and a bottom wafer 322 are provided. Dielectric aperture 324 is formed by opening holes in the metal 312 on both sides of one of the wafers, with via holes 326 surrounding the holes. The input signal path is shown by the arrow in FIG. 3B.

In an illustrative embodiment, the dielectric aperture 324 can be fed by a microstrip line 330 and corresponding wire bond 332. Electromagnetically, this forms a waveguide section 328 loaded with dielectric, the dielectric material being the material of the wafer in question. This type of structure has an advantage of allowing for hermetic sealing of the resonant structures.

As shown in FIG. 3B, dielectric aperture 324 is opened in the inside metal of the cavity which enables the input signal to be coupled into cavity 310. This aperture is coupled to a section of the dielectric loaded waveguide 328, which is formed in the bottom wafer by putting via holes and via slots around the edges of the waveguide. The vias do not need to be continuous, but the spaces between them should be small enough to prevent significant leakage of energy through them. This is achieved by making the size and geometry such that they are cutoff at the frequencies of interest. The dielectric waveguide 328 runs along the wafer to the edge of the device. There, it can be efficiently coupled to a transmission line mode, such as microstrip line 330 or coplanar waveguide.

Figure 3C:
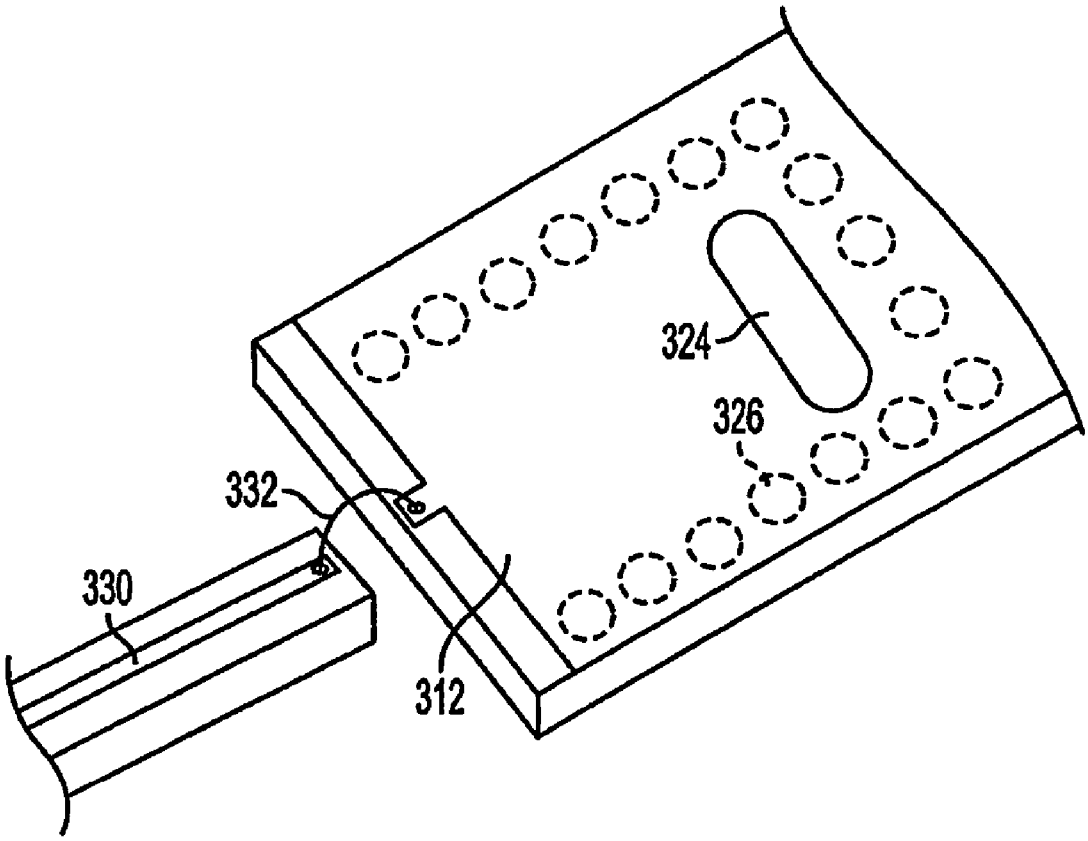

FIG. 3C shows an isometric view of the input structure on the bottom wafer in which a microstrip line 330 is shown coupling to the dielectric waveguide, with a connection made by wire bonding. Via holes 326 (or slots) connect the top metal to the bottom metal, and define a silicon waveguide structure, which transports the signal to the dielectric coupling aperture 324. The position of the via holes can be adjusted to provide tuning.

The microstrip line 330 can be formed by a variety of methods, such as electroplating gold through a patterned photoresist mask, which is well-known art. This microstrip line 330 ends on a large piece of patterned metal 312 on bottom wafer 322. Inside the cavity, the opening 324 in the metal is formed at the same time the microstrip line is patterned. The via holes 326 surround this opening, except on the side where the signal comes in, and direct the incoming signal to the opening in the metal, which couples the signal into the first resonant cavity 310.

Because the signal has to pass from a dielectric loaded transmission line into a free space resonator, there is a significant impedance mismatch, which weakens the coupling. However, because of the resonant nature of a bandpass filter, weak coupling at the input and output ports is perfectly acceptable. The weak coupling is "tuned out" by the resonators, allowing a nearly perfect match at the input and output in the passband of the filter.

To form the coupling structure, a masking layer for the anisotropic etch is deposited or grown on both sides of the wafer. This layer could be silicon dioxide or silicon nitride, for example. This masking layer is patterned and etched, leaving bare silicon where the via holes are to go. Next, a thin layer of seed layer metal is deposited on the front of the wafer. A photoresist layer is applied and patterned, and metal is electroplated through the mask. The photoresist is stripped off, and the seed layer metal is etched away using some standard process.

The wafer is then etched in an anisotropic silicon etch, such as Potassium Hydroxide in water. This forms rectangular pits in the wafer. The size of the openings is made such that the pits go entirely through the wafer. The pits are positioned so there is a gold membrane across the top of the pit. The masking layer is etched away, and metal is deposited on the backside. This metal makes electrical contact with the front side metal through the etched pits. The back of the wafer now has a complete ground plane, with via holes going through to the front side.

In another illustrative embodiment, the coupling structure is formed using a glass wafer. The starting wafer is a disk of glass, polished on both sides, with a well controlled thickness. Thickness control of +/− 10 microns is available commercially. First, holes are cut into the wafer. Holes can be either round, or any shape with rounded corners. There are several methods of cutting holes in glass with high precision, which will be familiar to those skilled in the art. These include laser drilling and ultrasonic drilling, among others.

After the holes are cut, metal is deposited on both sides of the wafer and inside the holes. This can be done using a variety of different methods. One such method would be to deposit the metal in a vacuum chamber using sputtering, which can give excellent sidewall coverage inside the holes. Another method is to deposit a thin layer of metal by sputtering, and electroplating a thicker metal layer on top of it.

Once the thick metal is deposited, photoresist is applied to one side of the wafer. A photomask is aligned to the hole pattern, and the photoresist is exposed and developed. The metal is etched away from the exposed area, leaving a pattern of metal on top of exposed glass. This process is repeated for the backside. Because of the via holes, electrical contact can easily be made between the top and bottom layers.

This wafer can then be bonded to the upper two wafers using any bonding technique, including thermocompression bonding, solder bonding, or any other wafer bonding method.

Several different input structures can be realized using this technique. Examples are a microstrip input, a co-planar waveguide input and a waveguide input. Each offers different advantages and disadvantages. The microstrip line is easy to fabricate, and is compatible with mounting techniques used for MMICs or other microwave components which are mounted and wirebonded. The co-planar waveguide design is compatible with direct soldering to a circuit board, with no wire bonding. Finally, the waveguide input is mounted by placing opening in the filter cavities over waveguide openings. This input gives the lowest loss and the best isolation.

Figure 4A:
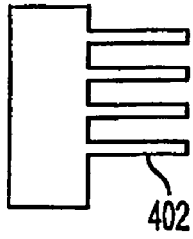
FIGS. 4A-4C show resonator structures according to other illustrative embodiments of the present invention.
Figure 4B:
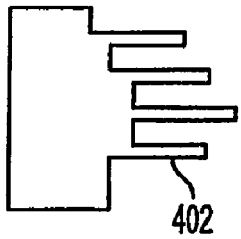
Figure 4C:
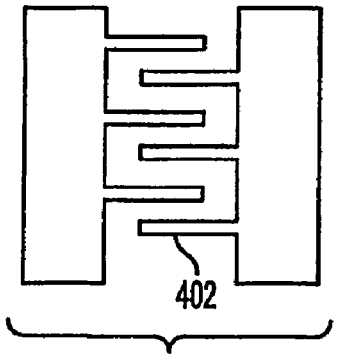

FIGS. 4A-4C show others resonator structures according to illustrative embodiments of the present invention. In FIG. 4A, a resonator is provided which uses suspended beams 402 that are similar to beams 202, as described above with reference to FIG. 2, but which are attached on one side of the structure only so as to form the resonators.

The advantage of this type of resonator is smaller size for a given Q and frequency than the H shaped resonators described above with reference to FIG. 2. The resonant frequency for the resonator shown in FIG. 4A depends on the length of the beam, and the coupling depends on the width of the beam and the spacing between beams.

As an alternative arrangement to that shown in FIG. 4A, the beams 402 can be staggered as shown in FIG. 4B or can be attached to opposite sides of the cavity as shown in FIG. 4C. In another arrangement, the beams 402 may be positioned so as to form a combline filter. These beams can be formed by a variety of processes, including deep reactive ion etching and anisotropic silicon wet etching.

If the resonator structures shown in FIGS. 4A-4C are formed with anisotropic silicon wet etching, convex corner protection is needed when forming the structures. This is due to the fact that that anisotropic silicon etchant etches convex corners very fast. Convex corner protection can be accomplished by using a mask feature to compensate for the etching of convex corners, as would be familiar to someone skilled in the art. However, another novel method for convex corner protection is described with reference to FIG. 5.

All known wet anisotropic silicon etches attack convex corners aggressively. Conventional methods for compensating involve providing extra, sacrificial, material on the convex corner that is consumed while the rest of the structure is being etched. The consumption of this sacrificial material must coincide with completion of the etch. Often, however, the convex corners produced in this manner are not highly controlled in their final shape.

The method described herein with reference to FIG. 5 protects convex corners by utilizing an etch mask. In FIG. 5, the left portion shows a cross sectional view and the right portion shows a top view. First, a wafer is patterned with small rectangular or square pits on one side of the wafer, as shown in FIG. 5A. These pits are designed to leave a very small opening on the other side of the wafer. As shown in FIG. 5B, the wafer is then etched in an anisotropic wet etch completely through the wafer.

Figure 5A:
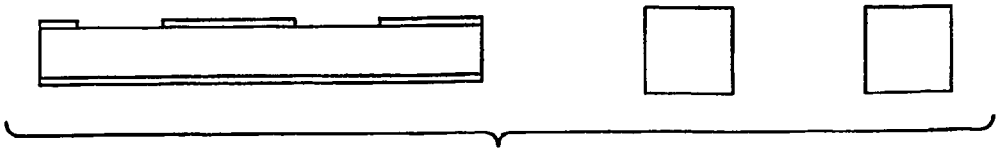
FIGS. 5A-5E show a method for convex corner protection according to an illustrative embodiment of the present invention.
Figure 5B:
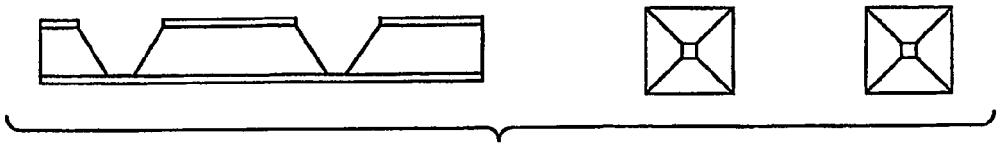
Figure 5C:
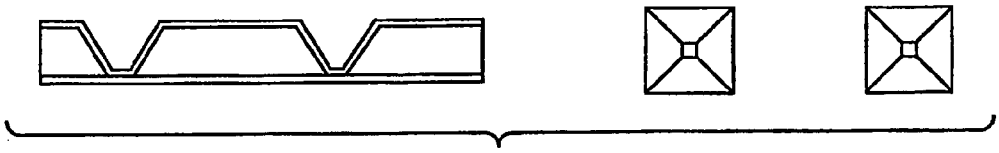

An etch masking layer is then grown over the back side of the wafer which covers the inside of the pits as shown in FIG. 5C. This film can be any number of masking materials familiar to those skilled in the art, including Silicon Nitride grown using chemical vapor deposition.

If the opening on the opposite side of the wafer is sufficiently small, and the masking material used is sufficiently strong, then a membrane can be left in place which will cover the top of the pit. This membrane can simplify the wafer handling (by hold vacuum), and also simplify the application of photoresist, as the wafer surface will be planar with no holes. This membrane is not required for the technique to work, but can simplify the subsequent processing of the wafer.

Figure 5D:
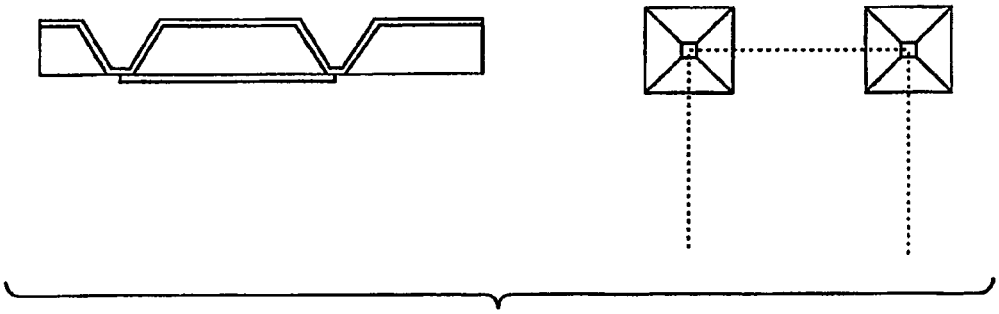
Figure 5E:
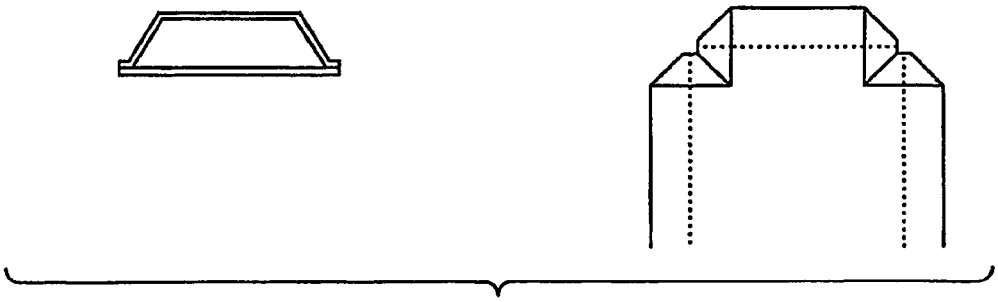

As shown in FIG. 5D, the masking layer on the opposite side is then patterned, with the convex corners on the masking layers laying over the pits etched through the wafers. The wafer is then etched in an anisotropic etchant, which will now not be exposed to any convex corners. The final etched structure will be completely defined by the lithography, with little dependence on the timing and details of the anisotropic etch. The final etched structure in the form of a cantilever is shown in FIG. 5E.

One skilled in the art will realize that the initial pit can be formed by a variety of different methods, including deep Reactive Ion etching, isotropic chemical etching, drilling, or any other suitable method. Cantilevers can be formed by methods other than anisotropic etching. Etching techniques can also be used which do not require convex corner protection. Such techniques include deep reactive ion etching, among others. The chosen etching technique will depend on the details of the design and the fabrication facility.

Figure 6:
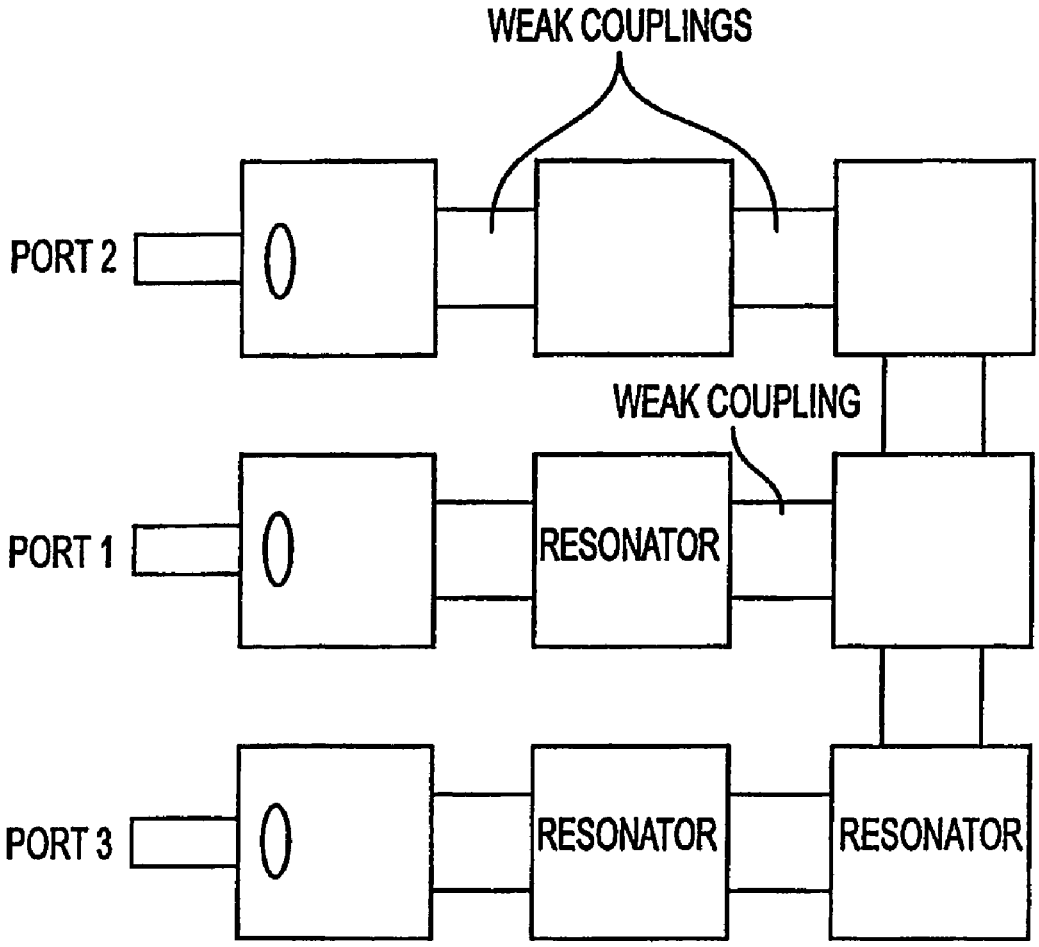
FIG. 6 shows a resonator structure in the form of a diplexer according to an illustrative embodiment of the present invention.

The rectangular cavities used in illustrative embodiments described herein allow for some resonators to have multiple couplings to neighboring resonators. This allows for the development of a diplexer which shares some resonators. As shown in FIG. 6, a diplexer is a device with three ports. If the ports are arbitrarily labeled as port 1, port 2 and port 3, then in a given frequency band, ports 1 and 2 are strongly coupled, while port 3 is isolated. In a second frequency band, ports 1 and 3 are strongly coupled, and port 2 is isolated. Often, the two frequency bands are very close to each other.

A diplexer can be made from two bandpass filters with frequency bands close to each other. This structure, however, requires the two filters to be very closely matched to each other. FIG. 6 shows a diplexer in which some of the resonators are shared. In FIG. 6, port 1 and port 2 are connected in one frequency band, while port 1 and port 3 are connected in an adjacent frequency band. Altering the non shared resonators and couplings gives sufficient degrees of freedom to realize a diplexer.

Such a configuration presents several advantages over conventional design. By using a single device instead of two filters and by sharing resonators, the space required is reduced and the complexity of mounting the devices is reduced. Another advantage is that the resonators will all be well matched (as they are fabricated at the same time), thus ensuring good isolation between ports 2 and 3 at all frequencies.

Another illustrative embodiment of the present invention is described with reference to a component used in radio frequency and millimeter wave systems, known as a local oscillator, or LO. The LO is a component that generates a single frequency, which is then used by other parts of the system. An LO is generally made from an active amplifier and a resonator, the resonator being a passive device that exhibits a narrow peak in frequency in its transfer function. The frequency of this peak is known as the resonant frequency.

The quality factor, or Q, of the resonator sets the lower limit for the amount of phase noise on the LO signal. Higher Q values give lower noise values, and vise versa. The resonator can be a two port device or a one port device. Conventional resonators include dielectric resonators, also known as DR's. These are constructed by attaching a disk of low loss dielectric next to a transmission line. The dielectric disk has a resonant frequency dependent on its dimensions and its dielectric constant. Because the disk is placed near the line, it is weakly coupled to the line.

At the resonant frequency, it strongly couples to the line, looking like a short circuit. The energy thus reflected at and near the resonant frequency. Away from the resonant frequency, it is very weakly coupled, and the energy passes freely through the transmission line.

However, because the resonator is a dielectric, the fields are not confined to the dielectric disk, but extend into the surrounding space. Shielding is needed to keep these fields from coupling to other parts of the circuit. The frequency usually requires tuning due to limitations in the control over the disk dimensions and dielectric constant. The tuning is done mechanically, in the form of a screw above the dielectric resonator, which perturbs the free space fields and alters the resonant frequency. In addition, the coupling between the transmission line and the disk depends on the exact placement of the disk, and hence is not well controlled.

A resonator is now described such that resonance occurs in an enclosed cavity and, therefore, there are no stray fields to couple to other parts of the circuit, so no additional shielding is necessary. This reduces the overall size of the LO. Also, the coupling strength is determined by the precisely fabricated coupling structure, and is independent of the details of device mounting. Hence the resonator coupling is much better controlled.

A resonator can be considered to be a weakly coupled, single pole filter. A resonator exhibits the characteristic of having a single resonant frequency, which can be used to build an oscillating circuit. The frequency of the oscillator is primarily determined by the resonant frequency of the resonator. To a much lesser degree it is affect by the oscillating circuit. This additional degree of freedom can be used to tune the oscillation frequency.

A top wafer, a middle wafer and a bottom wafer form a stack of wafers. The bottom wafer contains two coupling structures. The upper two wafers form the sealed cavity, with the floor of the cavity defined by the flat surface of the bottom wafer. The wafers are then bonded together, and the stack is cut into pieces using a dicing saw. The location of the resonant peak is determined by the dimensions and geometry of the cavity, and can be designed to be any value. The height of the peak can be determined by the coupling while the width of the peak varies with the Q of the cavity.

Due to the precision of the available micromachining technology, filters can be constructed without tuning which meet specifications that would require tuning for conventional machined filters. However, tuning might still be required in some applications. Tuning of a single resonator to shift the frequency up and down allows greater frequency precision for a given manufacturing tolerance. It also allows a single microfabricated device to be customized for different frequencies.

Tuning of a filter can be used to improve its performance in various aspects. Because some filter specifications are more sensitive to variations in resonator frequency, there will always be some filter specifications which are beyond the capability of the current manufacturing capability. In those cases, tuning can be used to compensate for limitation in the manufacturing capability.

The general principle behind tuning a resonator is that some controlled disturbance in the fields where the resonance is occurring will shift the resonant frequency. One method for tuning is to weakly couple some of the fields outside the cavity, and perturb them there. By keeping the coupling weak, the change in frequency will remain small and well controlled, and the Q of the resonator will not be significantly reduced.

Figure 7A:
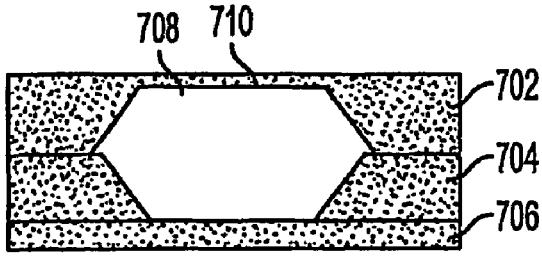
FIGS. 7A-7C show tuning structures according to illustrative embodiments of the present invention.

FIG. 7A shows a cross section of a cavity resonator having a top wafer 702, a middle wafer 704 and a bottom wafer 706. A resonator 708, being an air or vacuum space, is formed and is coated with metal 710, as described above. The cavity resonator shown in FIG. 7A has no tuning structure.

Figure 7B:
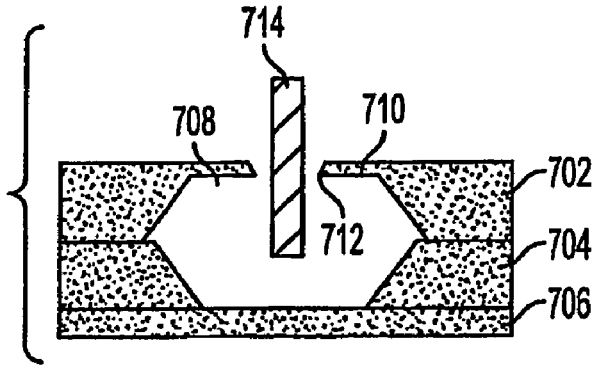

The cavity resonator shown in FIG. 7B, however, is formed with an opening 712 in the top wafer 702. Inside opening 712 is placed a piece of metal or low loss dielectric 714 that acts as a tuning structure for the filter. The amount of tuning can be tailored to the desired characteristics and is dependent on the size of dielectric 714.

Figure 7C:
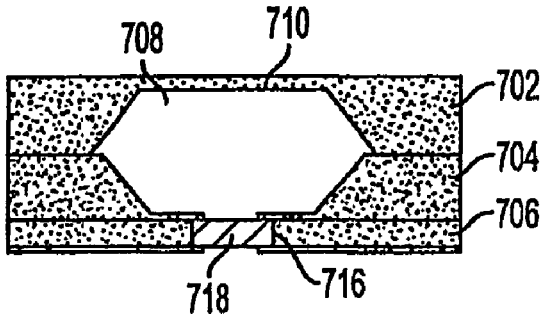

FIG. 7C shows a cross section of a cavity resonator having another form of tuning structure. In FIG. 7C, a hole 716 is formed in bottom wafer 706. A metal cap 718 is then placed in hole 716, which acts as the tuning structure for the filter. The height of cap 718 can be varied depending on the desired tuning. While only one resonant cavity is depicted in FIGS. 7A-7C, multiple resonant cavities and coupling cavities may be formed depending on the desired characteristics of the filter.

Figure 8:
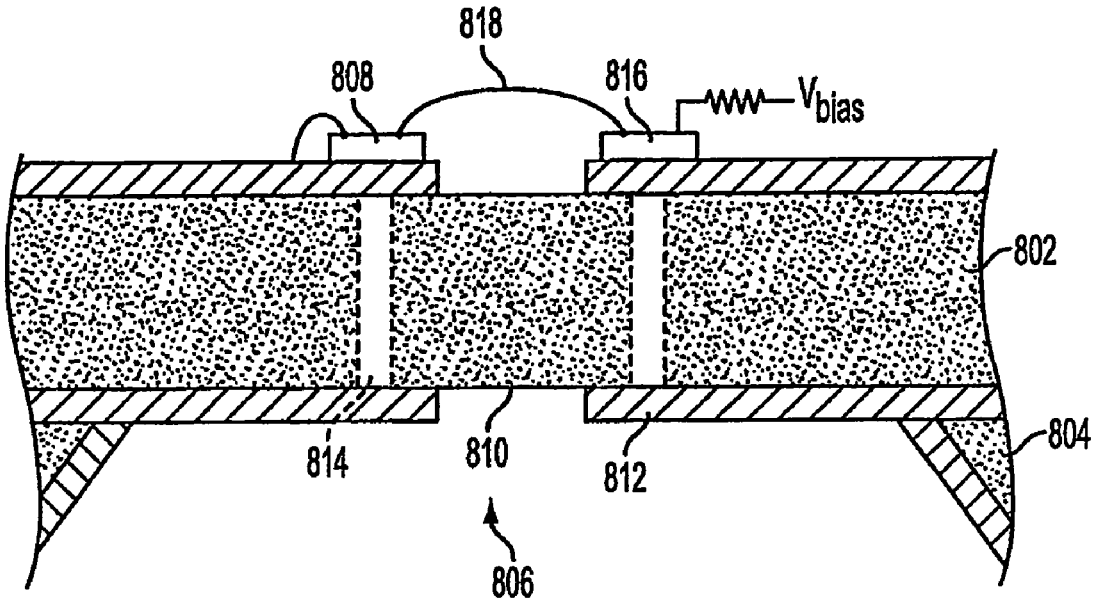
FIG. 8 shows a tuning structure according to another illustrative embodiment of the present invention.

Another tuning structure is described with reference to FIG. 8. In FIG. 8, a partial view of cavity resonator is shown having a top wafer 802, a middle wafer 804 and a resonant cavity 806. An external capacitive element 808 is placed on top wafer 802 and is used as the tuning structure. External capacitive element 808 has several uses. For example, if a varactor diode is used as capacitive element 808, then the frequency of the resonator can be tuned via an electrical signal. In the case of a single resonator being used as a frequency reference to generate a sine wave output, this allows phase locking of the output signal to some reference, the benefits of which are clear to those skilled in the art.

A method for providing resonator tuning via an external capacitive element is now described. A weakly coupled port is added to the resonant cavity to provide a method of tapping off a small amount of the energy. This port is connected to a capacitive element, which is shorted to ground at RF. By reducing the coupling of the resonant cavity to the capacitive element, the losses induced by the capacitive element can be reduced at the expense of the tuning range. In general, the capacitive element will have a lower Q than the resonant cavity, so weak coupling is required.

The weakly coupled port can be of the same type as the input structures already described above. The requirements of the port are slightly different, in that transition losses need to be minimized as much as possible, but the coupling typically does not need to be as strong. In addition, the signal does not need to come out to a well controlled impedance line. These differences in the requirements open the possibility for other types of coupling structures to be used as well.

In FIG. 8, the capacitive element 808 is shown on the top of the resonant cavity but could easily be inverted and placed on the bottom wafer (not shown). An aperture 810 is opened in the metal 812 inside the resonant cavity. The size and placement of the opening, as well as the operating frequency will determine the coupling strength. This can be used to design a coupling of the correct strength.

A waveguide structure is formed by putting via holes 814 around the opening. Note that the holes do not form a continuous slot, but are closely enough spaced to keep the signal confined. An opening on the reverse side is also made. This is easily realized on the bottom wafer.

A varactor diode 808, in series with a capacitor 816, is mounted and connected via a wirebond 818 so as to short across the outside opening. This provides capacitive loading. Bias voltage applied to the varactor diode changes the loading capacitance, shifting the resonator frequency. In this embodiment, no RF transmission line is needed, as the only external signal applied is the DC voltage bias. This allows for more flexibility in the design of tuning apertures than in the RF input and output structures.

The previous description of embodiments is provided to enable a person skilled in the art to make and use the present invention. Moreover, various modifications to these embodiments will be readily apparent to those skilled in the art, and the generic principles and specific examples defined herein may be applied to other embodiments without the use of inventive faculty.

For example, some or all of the features of the different embodiments discussed above may be combined into a single embodiment. Conversely, some of the features of a single embodiment discussed above may be deleted from the embodiment. Therefore, the present invention is not intended to be limited to the embodiments described herein but is to be accorded the widest scope as defined by the limitations of the claims and equivalents.

What is claimed is:

1. A resonator assembly comprising: a first wafer; at least one pit etched in said first wafer; a second wafer coupled to said first wafer; at least one pit etched in said second wafer; a third wafer coupled to said second wafer; a layer of metal disposed on at least one of said first wafer, said second wafer, and said third wafer; a transmission line which carries an input signal; an input structure which enables the input signal to be introduced into at least one cavity from said transmission line and which comprises an aperture formed in said layer of metal disposed on at least one of the first wafer, second wafer, and third wafer; and a plurality of via holes surrounding the aperture formed in the layer of metal; wherein said at least one pit etched in said first wafer and said at least one pit etched in said second wafer are arranged so as to form said at least one cavity.

2. A resonator assembly comprising:

a first wafer;

at least one pit etched in said first wafer;

a second wafer coupled to said first wafer; and at least one pit etched in said second wafer, wherein said at least one pit etched in said first wafer and said at least one pit etched in said second wafer are arranged so as to form at least one cavity wherein said at least one pit etched in said first wafer comprises a first plurality of pits, wherein said at least one pit etched in said second wafer comprises a second plurality of pits, and wherein the first plurality of pits and second plurality of pits are arranged so as to form a plurality of cavities and wherein the plurality of cavities comprises:

a first resonator cavity;

a second resonator cavity;

and a cavity forming a coupling aperture disposed between said first resonator cavity and said second resonator cavity.

3. The resonator assembly according to claim 2, wherein the plurality of cavities are disposed so as to form a filter.

4. The resonator assembly according to claim 2, wherein at least one of the second plurality of pits is etched completely through the second wafer.

5. The resonator assembly according to claim 2, further comprising a third wafer coupled to said second wafer.

6. The resonator assembly according to claim 5, further comprising a layer of metal disposed on at least one of said first wafer, said second wafer, and said third wafer.

7. A resonator assembly comprising:

a first wafer;

at least one pit etched in said first wafer;

a second wafer coupled to said first wafer; and at least one pit etched in said second wafer, a third wafer coupled to said second wafer;

a layer of metal disposed on at least one of said first wafer, said second wafer, and said third wafer;

a tuning structure that is able to adjust a frequency characteristic of the resonator assembly;

an aperture formed in at least one of said first wafer, said second wafer, and said third wafer, wherein said at least one pit etched in said first wafer and said at least one pit etched in said second wafer are arranged so as to form at least one cavity; and wherein said tuning structure comprises a metal cap that is provided in said aperture.

8. The resonator assembly according to claim 7. further comprising:

an aperture formed in said layer of metal, wherein said tuning structure comprises a capacitive element that is provided on at least one of said first wafer, said second wafer, and said third wafer.

9. The resonator assembly according to claim 8, wherein the capacitive element comprises a varactor diode.

10. A resonator assembly comprising:

a first wafer;

at least one pit etched in said first wafer;

a second wafer coupled to said first wafer;

at least one pit etched in said second wafer;

a third wafer coupled to said second wafer;

a layer of metal disposed on at least one of said first wafer, said second wafer, and said third wafer;

a tuning structure that is able to adjust a frequency characteristic of the resonator assembly;

an aperture formed in said layer of metal; and a plurality of via holes that extend through at least one of said first wafer, said second wafer, and said third wafer; wherein said at least one pit etched in said first wafer and said at least one pit etched in said second wafer are arranged so as to form at least one cavity and wherein the via holes are formed so as to surround said aperture formed in said layer of metal.

11. A resonator assembly comprising:

a first wafer;

at least one pit etched in said first wafer;

a second wafer coupled to said first wafer;

a plurality of pits etched in said second wafer;

a third wafer coupled to said second wafer; and at least one pit etched in said third wafer, wherein said plurality of pits etched in said second wafer are etched such that said second wafer forms a beam extending from at least a first end of the resonator assembly.

12. The resonator assembly according to claim 11, wherein said plurality of pits etched in said second wafer are etched such that the beam extends from the first end of the resonator assembly to a second end of the resonator assembly.

13. The resonator assembly according to claim 12, wherein the beam is formed so as to be substantially H-shaped.

14. The resonator assembly according to claim 11, wherein a plurality of the beams are arranged so as to form a filter.

15. The resonator assembly according to claim 11, wherein the at least one pit etched in said first wafer and the at least one pit etched in said third wafer are arranged so as to form a cavity such that the beam formed by said second wafer is disposed within the cavity.

16. The resonator assembly according to claim 11, further comprising a fourth wafer coupled to said third wafer.

17. The resonator assembly according to claim 16, further comprising a layer of metal provided on at least one of said first wafer, said second wafer, said third wafer, and said fourth wafer.

18. A method for convex corner protection comprising:

providing a wafer having a first etch masking layer on a first side of said wafer and a second side of said wafer, wherein the second side is disposed opposite to the first side;

patterning a first pit and a second pit on the first side of the wafer;

etching the wafer so as to form the first pit and the second pit in said wafer;

providing a second etch masking layer on the first side of the wafer such that an inside of the first and second etched pits are covered by the second etch masking layer;

patterning the wafer on the second side of said wafer such that the second masking layer is disposed only in an area between the first and second etched pits; and etching the second side of said wafer so as to remove the portion of the wafer not covered by the second masking layer.

19. The method for convex corner protection according to claim 18, wherein etching the first pit and the second pit in said wafer comprises etching the first and second pits so as to leave a first opening and second opening in the second side of said wafer.

* * * * *